US007572166B2

(12) United States Patent
Blum et al.

(10) Patent No.: US 7,572,166 B2
(45) Date of Patent: Aug. 11, 2009

(54) TRANSFORMABLE SCENERY

(75) Inventors: Steven C. Blum, Orlando, FL (US); Justin Michael Schwartz, Orlando, FL (US); Scott R. Trowbridge, Windermere, FL (US)

(73) Assignee: Universal City Studios LLLP, University City, CA (US)

( * ) Notice: Subject to any disclaimer, the term of this patent is extended or adjusted under 35 U.S.C. 154(b) by 458 days.

(21) Appl. No.: 11/457,160

(22) Filed: Jul. 13, 2006

(65) Prior Publication Data

US 2008/0015037 A1 Jan. 17, 2008

(51) Int. Cl.
*A63H 17/02* (2006.01)
*A63H 17/00* (2006.01)

(52) U.S. Cl. ..... 446/6; 446/220; 472/72

(58) Field of Classification Search ..... 446/4, 446/6, 220, 221, 225, 226; 472/72, 74, 134
See application file for complete search history.

(56) References Cited

U.S. PATENT DOCUMENTS

| | | | | |
|---|---|---|---|---|
| 4,508,521 | A * | 4/1985 | Klimpert et al. | 446/486 |
| 5,131,880 | A | 7/1992 | Nesbit | |
| 5,419,729 | A * | 5/1995 | Gross | 446/183 |
| 5,713,783 | A * | 2/1998 | Szoke et al. | 446/456 |
| 6,302,171 | B1 * | 10/2001 | Watts | 141/317 |

FOREIGN PATENT DOCUMENTS

| | | |
|---|---|---|
| GB | 18264 | 4/1912 |
| GB | 2033764 | 5/1980 |

* cited by examiner

*Primary Examiner*—Kien T Nguyen
(74) *Attorney, Agent, or Firm*—General Electric Global Patent Operation; Roger C. Phillips

(57) ABSTRACT

Transformable scenery includes a shell wherein at least one discrete portion of the shell is configured to be transformable between one outward appearance and one or more other outward appearances wherein the one outward appearance and the one or more other outward appearances are three-dimensional.

20 Claims, 3 Drawing Sheets

TRANSFORMABLE SCENERY

BACKGROUND OF THE INVENTION

1. Field of the Invention

The subject matter described herein relates generally to scenery for entertainment and amusement and, more particularly, to devices and methods for transforming or altering scenery.

2. Related Art

To provide high entertainment value for today's sophisticated customer, themed entertainment venues, such as theme parks and amusement parks, include a variety of live action outdoor shows and theatrical productions throughout the venue. Many of these shows and productions include scenery that undergoes a transformation or substantial change during the action. For example, some shows and productions include a substantial number of action scenes such as car chases, gunfights and the like. During these action scenes, occasionally it is necessary to create an illusion of damage to individual items or equipment of the scenery. For entertainment venues, where the same event must be repeated many times during a day, it is not cost effective or practical to actually physically destroy or damage the scenery.

Currently, various techniques for creating an illusion of damage to scenery are employed. In one, a mechanical device uses pneumatically or hydraulically powered, mechanical linkages to create such an illusion. One such mechanical device is shown in practice at Universal Studios Florida "Earthquake" attraction. At this attraction, mechanical linkages change seemingly undamaged vehicles and objects into damaged ones during a simulated earthquake. This is accomplished by using mechanical linkages connected to various locations on one particular item of scenery, such as a lamppost or an oil tanker. To create a damaged condition, the mechanical linkages physically separate the item into various seemingly "broken" components.

Another way to create such an illusion is through the use of "smoke and mirrors", e.g., at an opportune moment in a production, a visual effect is provided to draw an audience's attention to one position while simultaneously, replacing an undamaged item with a damaged one at another position. Also, creating an illusion of damage to scenery may be accomplished through high-resolution video/projection, where scenery may be changed via editing during production, and through other visual techniques such as Pepper's Ghost effects and via the use of Scrims.

Pepper's Ghost effects are illusionary techniques used in theatre and in some magic tricks. Using a pane of refractive media (glass) and special lighting techniques, scenery can seem to appear or disappear, or "morph" from one aspect into another. In either case, the viewer sees into a main room having a pane of glass, but not into an adjoining room, the image of which is reflected on the glass. To increase the effectiveness of the technique, the adjoining room may be painted black, with only light-colored scenery of interest provided in it. When light is cast on the scenery, it will reflect strongly in the glass. Using this technique scenery may be instantly lighted up in the adjoining room such that its reflection will cover up the previously seen scenery, located in the main room, in order to create a "morph" effect. The reflected object is usually physical set pieces and animated/non-animated figures with direct view and projected visual display devices.

A scrim is a thin screen, made out of a wide variety of materials, that when lit from the front appear opaque to the viewer, until a change in stage lighting (lighting from behind) causes the scrim material to appear to be almost fully transparent. Two-dimensional scenery, may be transformed via this technique from one aspect to another. For example, a two-dimensional brick wall, may be applied to one side of the scrim while located behind the scrim is another brick wall that is broken. As long as the scrim is lit from the front the viewer sees the solid brick wall applied to the scrim and, once it is lit from behind, the broken brick wall is then visible through the scrim.

However, none of the foregoing is realistic enough in an outdoor venue, due to light control, to provide the high entertainment value demanded by a sophisticated audience. Furthermore, these techniques only provide ways to show the before and after effects of scenery being transformed.

BRIEF DESCRIPTION OF THE INVENTION

In accordance with an embodiment of the present invention, transformable scenery comprises a shell wherein at least one discrete portion of the shell is configured to be transformable between one outward appearance and one or more other outward appearances and wherein the one outward appearance and the one or more other outward appearances are three-dimensional.

In another embodiment of the present invention, a method of transforming scenery comprises providing a shell; and transforming at least one discrete portion of the shell between one outward appearance and one or more other outward appearances, wherein the one outward appearance and the one or more other outward appearances are three-dimensional.

BRIEF DESCRIPTION OF THE DRAWINGS

The following detailed description is made with reference to the accompanying drawings, in which.

DETAILED DESCRIPTION OF THE PREFERRED EMBODIMENT

One embodiment of the present invention concerns a device and a method for providing an illusion of damaged or destroyed scenery by using a material that is deformed by the use of a vacuum or low-pressure pump.

As part of the disclosure hereof, the term scenery is intended to broadly refer to any article, item, equipment, property, or prop that is movable or stationary and used in a theatrical performance, show, video or movie presentation. Transformable refers to that which is changeable from one outward appearance to another outward appearance.

Figure 1:
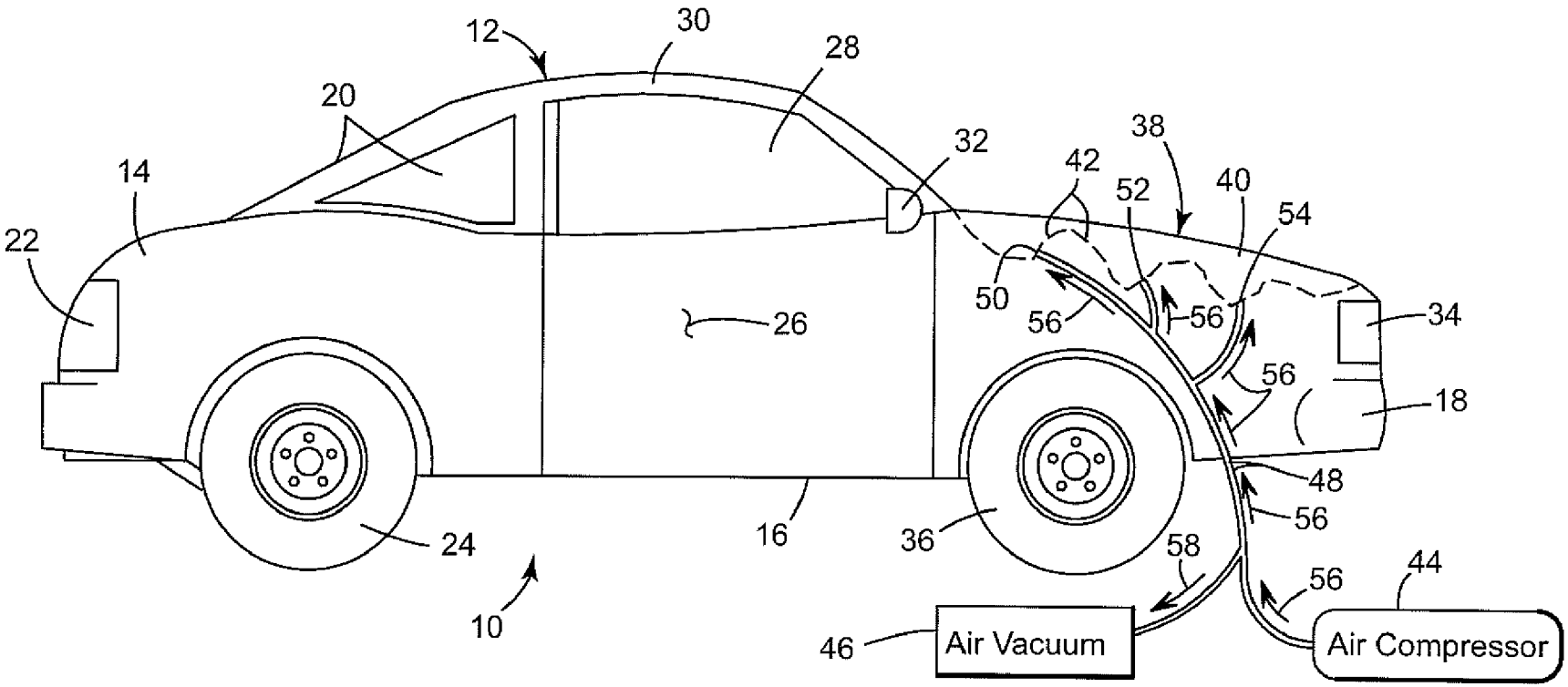
FIG. 1 is a diagram showing transformable scenery in an untransformed state and in accordance with an embodiment of the present invention.

Referring now to FIG. 1, transformable scenery in accordance with one embodiment of the present invention is illustrated generally at 10. In this embodiment, the scenery 10 comprises an automobile that has an outer shell 12 comprising various known materials including, e.g., metallic, glass and/or plastic substances and various discrete portions such as a rear portion 14, an intermediate portion 16 and a front portion 18. Each of the rear portion 14 and intermediate portion 16 is fabricated in a known manner and the rear portion comprises, among other things, conventional windows 20, taillights 22 and wheels 24. The intermediate portion 16 comprises conventional doors 26, windows 28, a roof structure 30 and rear view mirrors 32. It will be understood that the scenery 10 is a three-dimensional object and is not merely a two-dimensional image thereof. In various optional embodiments the scenery 10 may comprise, e.g., a building, a machine, a portion of an animated figure and a component such as a speaker or a television set.

Figure 2:
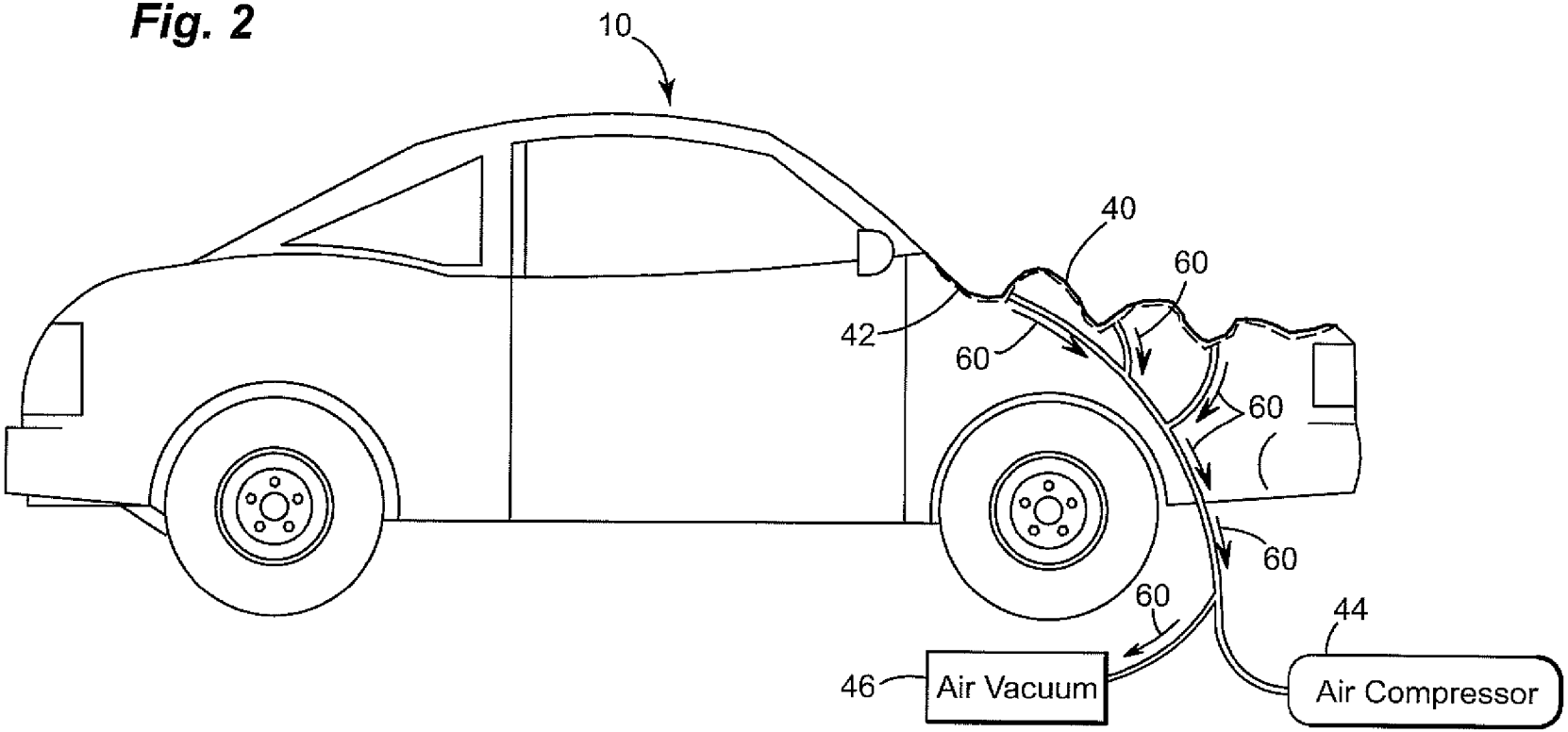
FIG. 2 is a diagram showing the scenery of FIG. 1 in a transformed state.

The front portion 18 comprises conventional headlights 34 and wheels 36 and, in accordance with a feature of the present invention, at least one portion 38 of the shell 12 that is configured to be transformable from one outward appearance to another outward appearance (shown in FIG. 2). Although shown as a side view, it will be appreciated that the general outward configuration of the portion 38 is generally circular in one embodiment or generally rectangular in another and, as in the present embodiment, covers only a small portion of the scenery 10 and in another embodiment covers a larger portion of the scenery.

As illustrated, the portion 38 comprises a bladder 40 that is supported by a shaped surface 42. The bladder 40 comprises a flexible material, such as a polyester film, e.g., that sold under the mark MYLAR, a polypropylene, a soft polyethylene, a polyamide such as a nylon, a polyurethane, a latex and a rubber or some combination thereof such as a nylon shell with an additional inner MYLAR bladder, that is capable of being coated with, e.g., a paint or other pigmented material to match the color and/or other overall scheme of the shell 12. The bladder 40 has a cavity (not shown) that may be expanded or contracted via the use of a fluid, e.g., a gaseous medium such as air supplied by an air compressor 44 and a vacuum or low pressure pump 46 and communicated to the bladder via a tube network 48. In an optional embodiment, a reversible pump may be employed instead of the separate air compressor and vacuum pump 46.

In another optional embodiment, the air compressor 44 and air vacuum 46 may be located within the shell 12 rather than outside thereof as shown. For example, the compressor 44 and pump 46 can be hidden from view within the shell 12 so that the scenery 10 is self-contained and thus also may be movable. In a further optional embodiment, the gaseous medium employed is nitrogen or helium instead of air. In another optional embodiment, the air compressor 44 or low pressure pump 46 provides a variable pumping rate to provide for a slow rate of pressure change within the bladder 40. This may be advantageous to provide a "slow motion" effect where the bladder slowly deflates or inflates to change the appearance of the scenery 10. Further, the variable rate could be utilized to begin transforming the scenery 10 at a first rate, followed by at least one other rate of transformation until the transformation is complete.

The shaped surface 42, in this embodiment, comprises an irregular, jagged, non-uniform shape in cross section to create a damaged-like appearance. The shaped surface 42 comprises in various optional embodiments a metallic material, a molded polymeric substance such as another bladder having a fluid disposed therein, discrete frame elements and any of the foregoing materials including perforations. The shaped surface 42 comprises apertures 50, 52 and 54 through which the tube network 48 extends.

Referring now also to FIG. 2, in operation, transforming the scenery 10 comprises transforming the portion 38 of the shell 12 between one outward appearance and another outward appearance. To achieve the foregoing, the air compressor 44 may be switched on to pump pressurized air, represented by arrows 56 into the bladder 40 for expanding the bladder to a first extended position, shown in FIG. 1, which creates an outward appearance that, in this embodiment, is a simulated undamaged configuration. Also, in this embodiment, the air vacuum 46 is set to bleed off air, represented by arrow 58, to maintain a desired pressure.

Upon the desire to create another outward appearance of the portion 38 of the shell 12, which in this embodiment is a simulated damaged configuration, the air compressor 44 may be switched "off" whereupon the air vacuum 46 creates a low pressure for the air, represented by arrows 60, to escape from the bladder 40 which may then collapse to a contracted position, revealing the configuration of the shaped surface 42. It will be appreciated that an intermediate lower pressure level of air may be maintained to prevent the bladder 40 from completely collapsing. This may be advantageous with a particular scenery 10 (not shown) where a "ripple effect" may be desired.

Figure 3:
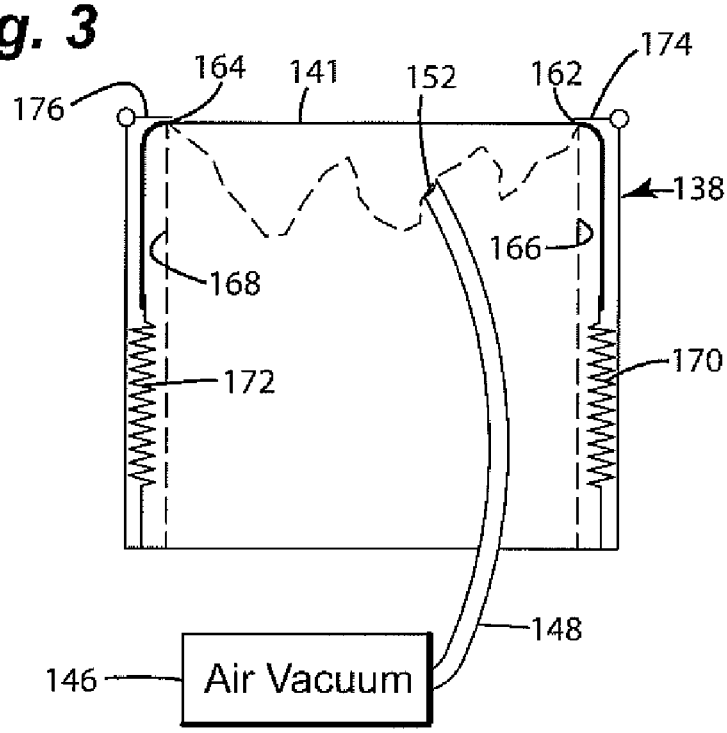
FIG. 3 is a diagram showing a cross-sectional view of a portion of transformable scenery in an untransformed state and in accordance with another embodiment of the present invention.

Another embodiment of a portion 138 of a transformable scenery is illustrated in cross section in FIG. 3. In this embodiment, the portion 138 comprises, instead of a bladder 40, a sheet 141 of flexible material and a shaped surface 142. The sheet 141 comprises any similar material to that described above with respect to the bladder 40 described above and, depending upon the application, in various embodiments may comprise a material with a high tensile strength of greater than approximately 40 Mega Pascal or a material with biased tensile properties, i.e. a material that can stretch in only direction. In particular, a material with a high tensile strength is desirous for an application where the sheet 141 may not stretch such as where a particular shaped surface 42 has a generally flat configuration. A material with biased tensile property is desirous for an application that includes a shaped surface that is tensioned in only one direction, such as a cylindrical shape tensioned only along an arcuate or circumferential portion thereof.

The sheet 141 extends beyond outer edges 162 and 164 of the shaped surface 142 into opposing cavities 166 and 168. As shown the sheet 141 is biased by springs 170 and 172 to create tension and the first outward appearance, which in this embodiment, is a simulated undamaged configuration. It will be appreciated that a single or multiple springs and cavities may be employed in the practice of this invention.

Gaskets 174 and 176 are provided for creating a seal. The shaped surface 142 comprises a similar material to that of the shaped surface 42 described above and comprises an aperture 152. A tube 148 is connected at one end to the aperture 152 and at the other is connected with an air vacuum 146. In an optional embodiment the shaped surface comprises a wire mesh.

Figure 4:
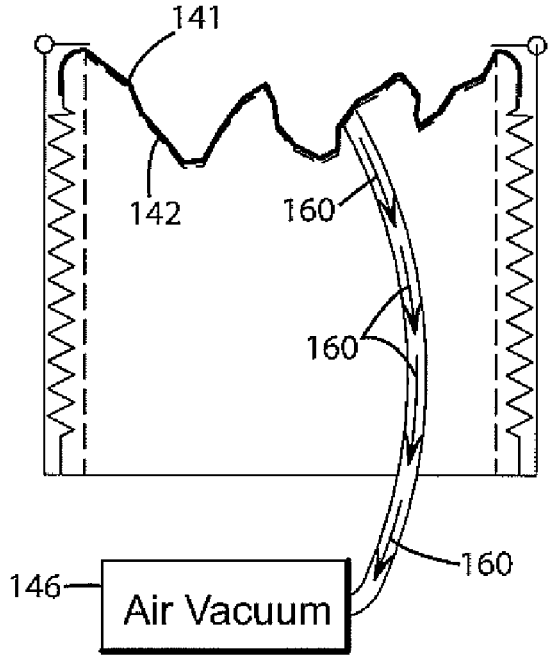
FIG. 4 is a diagram showing the scenery of FIG. 3 in a transformed state.

Referring now to FIGS. 3 and 4, the transforming the portion 138 of the shell 12 between one outward appearance, a simulated undamaged configuration, and another outward appearance, a simulated damaged configuration may be accomplished by switching "on" the air vacuum 146 whereupon the air vacuum creates a low pressure for the air, represented by arrows 160, to escape from between the sheet 141 and the shaped surface 142 whereby the sheet is collapsed adjacent the shaped surface revealing the configuration of the shaped surface.

While the present invention has been described in connection with what are presently considered to be the most practical and preferred embodiments, it is to be understood that the present invention is not limited to these herein disclosed embodiments. Rather, the present invention is intended to cover all of the various modifications and equivalent arrangements included within the spirit and scope of the appended claims.

What is claimed is:

1. Transformable scenery comprising:

a shell wherein at least one discrete portion of the shell is configured to be transformable between one outer appearance and one or more other outer appearances, wherein the one outer appearance and the one or more other outer appearances are three-dimensional, the at least one discrete portion of the shell comprising:

a shaped surface comprising a rigid or semi-rigid mesh having a non-uniform shape in cross section; and a flexible material supported by the shaped surface and the flexible material configured to receive a medium for expanding the flexible material to a first extended position which creates the one or more other outer appearances and to second contracted position adjacent the shaped surface which creates the one outer appearance;

wherein the one outer appearance is a damaged appearance.

2. The scenery of claim 1, wherein the medium comprises air and further comprising at least one air pump communicating via at least one aperture to an interior of the flexible material.

3. The scenery of claim 2, wherein the at least one air pump comprises an air compressor and a vacuum pump and the at least one aperture comprises a plurality of apertures.

4. The scenery of claim 1, wherein the flexible material comprises a bladder.

5. The scenery of claim 4, wherein the shell comprises a predetermined configuration and wherein the one or more other outer appearances include a simulated undamaged configuration.

6. The scenery of claim 5, wherein the bladder comprises an outer surface that is painted or otherwise treated to match the shell.

7. The scenery of claim 6, wherein the bladder comprises a flexible material that is impervious to a fluid disposed therein.

8. The scenery of claim 7, wherein the shell comprises a portion of a vehicle.

9. The scenery of claim 1, wherein the flexible material comprises a material comprising a tensile strength of greater than 40 Mega Pascal.

10. The scenery of claim 1, wherein the flexible material comprises biased tensile properties.

11. The scenery of claim 1, further comprising at least one cavity located proximal to the shaped surface and wherein an outer edge of the flexible material is biased within the cavity.

12. The scenery of claim 11, further comprising at least one spring disposed within the cavity and being connected with an outer edge of the flexible material for biasing the flexible material within the cavity.

13. The scenery of claim 12, further comprising a gasket dimensioned to cover the at least one cavity.

14. The scenery of claim 13, wherein the at least one cavity is disposed peripherally about the shaped surface and the at least one spring comprises a plurality of springs spaced about the periphery of the outer edge of the flexible material.

15. The scenery of claim 14, wherein the shell comprises a portion of a vehicle.

16. The scenery of claim 1, wherein the at least one discrete portion of the shell comprises a plurality of discrete portions of the shell.

17. A method of transforming scenery comprising:

providing a shell having at least one discrete portion, the discrete portion comprising a shaped surface having a rigid or semi-rigid mesh with a non-uniform shape in cross section and locating a flexible material on the shaped surface; and transforming the at least one discrete portion of the shell between one outer appearance and one or more other outer appearances, wherein the one outer appearance and the one or more other outer appearances are three-dimensional, and wherein the one outer appearance is a damaged appearances.

18. The method of claim 17, wherein transforming at least a portion of the shell between one outer appearance and one or more other outer appearances comprises:

pumping high pressure or low pressure fluid into the flexible material for respectively expanding the flexible material to a first extended position which creates the one or more other outer appearances and to second contracted position adjacent the shaped surface which creates the one outer appearances.

19. The method of claim 18, wherein the shell comprises a predetermined configuration and wherein the one or more other outer appearances include a simulated undamaged configuration.

20. The method of claim 18, wherein transforming at least a portion of the shell between one outer appearance and one or more another outer appearances comprises varying the rate of pumping of the fluid.

* * * * *

UNITED STATES PATENT AND TRADEMARK OFFICE

CERTIFICATE OF CORRECTION

PATENT NO. : 7,572,166 B2
APPLICATION NO. : 11/457160
DATED : August 11, 2009
INVENTOR(S) : Blum et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 487 days.

Signed and Sealed this

Seventh Day of September, 2010

David J. Kappos

David J. Kappos
*Director of the United States Patent and Trademark Office*